United States Patent [19]

Asano

[11] Patent Number: 4,607,997

[45] Date of Patent: Aug. 26, 1986

[54] SIDE SHIFTING ATTACHMENT FOR FORK LIFT TRUCKS

[75] Inventor: Masakazu Asano, Ohbu, Japan

[73] Assignee: Kabushiki Kaisha Toyoda Jidoshokki Seisakusho, Aichi, Japan

[21] Appl. No.: 645,616

[22] Filed: Aug. 29, 1984

[30] Foreign Application Priority Data

Sep. 2, 1983 [JP] Japan ..... 58-137205[U]

[51] Int. Cl.[4] ..... B66F 9/14

[52] U.S. Cl. ..... 414/667; 414/671; 384/13

[58] Field of Search ..... 414/667, 671, 785; 308/5 R

[56] References Cited

U.S. PATENT DOCUMENTS

| | | | |
|---|---|---|---|
| 3,819,078 | 6/1974 | Walsh | 414/671 |
| 3,974,927 | 8/1976 | Schuster | 414/667 |
| 3,999,675 | 12/1976 | Forry et al. | 414/667 X |
| 4,165,008 | 8/1979 | Faust et al. | 414/667 X |
| 4,392,773 | 7/1983 | Johannson | 414/667 |
| 4,406,575 | 9/1983 | Gaibler | 414/667 |
| 4,491,373 | 1/1985 | Sugi et al. | 308/5 R |

FOREIGN PATENT DOCUMENTS

| | | | |
|---|---|---|---|
| 2030542 | 4/1980 | United Kingdom | 414/667 |
| 2040367 | 8/1980 | United Kingdom | 384/13 |

*Primary Examiner*—Robert J. Spar
*Assistant Examiner*—Ken Muncy
*Attorney, Agent, or Firm*—Burgess, Ryan & Wayne

[57] ABSTRACT

A side shifting attachment for a fork lift truck having an upper shift bar and a lower shift bar for allowing transversal shifting movement of the attachment having load handling fork tines. The upper shift bar is engaged with an upper finger bar held by the truck body, via a transversally extending liner. Slide pads are also disposed between the upper shift bar and the upper finger bar for establishing a small gap therebetween as well as for preventing movement of the upper shift bar relative to the upper finger bar.

4 Claims, 7 Drawing Figures

SIDE SHIFTING ATTACHMENT FOR FORK LIFT TRUCKS

BACKGROUND OF THE INVENTION

1. Field of the Invention

The present invention relates to a side shifting attachment for fork lift trucks, more particularly to an improvement in the mechanical construction of a side shifting attachment which will enhance the operational performance and increase the working life thereof.

2. Description of the Prior Art

A conventional fork lift truck with side-shiftable fork tines is disclosed, for example, in PCT application No. PCT/JP79/00218 of the same assignee, now WO 80/00434. In this type of construction, the side-shiftable fork tines are mounted by means of a conventional side shifting attachment on a lift bracket moving up and down on uprights arranged on a foremost end of the truck body, and are moved transversely by a transverse actuator of the side shifting attachment consisting of a well known fluid-operated cylinder. In the conventional side shift attachment, the transverse movement of the fork bar is assisted by rollers, or by a liner, placed between the fork bar and the finger bar attached to the lift bracket. Where a liner is used, a problem arises wherein, when a load is lifted and the upright masts tilted back, the fork bar presses against the finger bar, causing abrasion and wear of the fork bar and finger bar during transverse movement. In an attempt to combat this problem, a gap is left between the finger bar and the fork bar. The width of this gap is determined and maintained by shims inserted between the liner and the fork bar. This construction will be later explained in detail. However, the presence of this gap allows a "rocking" motion to occur when a load is lifted or set down by the fork tines. That is, the fork bar is pushed backward when the fork tines are inserted into, for example, a loaded pallet, and is pulled forward when the fork tines take the weight of the loaded pallet. These actions cause the liner to move accordingly, i.e., cause play between the liner and the fork arm, with the result that the shims are moved out of position, the gap is accordingly widened, and the play is subsequently increased.

SUMMARY OF THE INVENTION

An object of the present invention is to provide a side shifting attachment for fork lift trucks with an improved mechanical construction that will not allow play of the liner member arranged between an upper shifter and an upper finger during various load handling operations of the fork lift truck.

In accordance with the present invention, there is provided a side shifting attachment secured to a fork lift truck having a lift bracket movable up and down on upright masts, and a pair of upper and lower finger bars extending transversely and attached to upper and lower spaced positions of the lift bracket, respectively. The side shifting attachment for shiftably supporting thereon fork tines is characterized in that it comprises a transversely extending upper fork bar engageable with an upper end of the fork tines, a transversely extending lower fork bar vertically spaced from the upper fork bar and engageable with a lower end of the fork tines, upper shift bar means fixed to the upper fork bar and transversely slidably engaged with the upper finger bar via a transverse liner, a lower shift bar means fixed to the lower fork bar and transversely slidably engaged with the lower finger bar, a shift actuator arranged in front of the upper and lower finger bars for producing a transverse shift of the upper and lower fork bars along the upper and lower finger bars, slide guide means arranged between the lower fork bar and the lower finger bar for sliding the lower fork bar during the transverse shift of the upper and lower fork bars, and slide pad means arranged between the upper fork bar and the upper finger bar for smoothly moving the upper fork bar during the transverse shift of the upper and lower fork bars. Preferably, the slide pad means comprise a pair of slide plate members having a predetermined thickness and a plain face, respectively, in contact with a plain surface of the upper finger bar. The slide pad means per se are attached to the upper shaft bar means.

BRIEF DESCRIPTION OF THE DRAWINGS

The present invention will be made more apparent from the ensuing description of the embodiment thereof with reference to the accompanying drawings, wherein.

DESCRIPTION OF THE PREFERRED EMBODIMENTS

To assist in a better understanding of the advantages to be gained from the present invention, a detailed explanation of the conventional side shifting attachment previously described will now be given with reference to the drawings.

Figure 2:
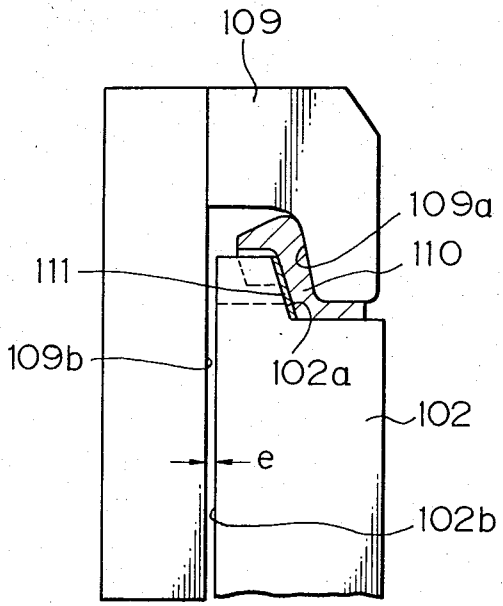
Fig. 2 PRIOR ART
FIG. 2 is an enlarged view of portion B of FIG. 1.
Figure 1:
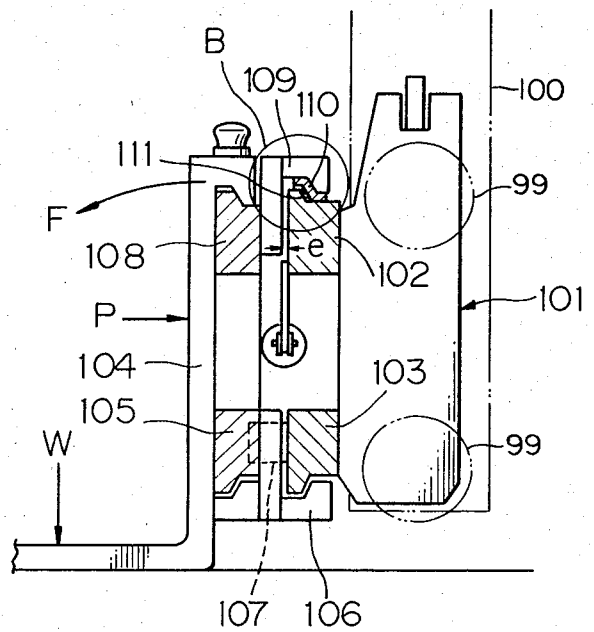
Fig. 1 PRIOR ART
FIG. 1 is a partial cross-sectional view of a side shifting attachment of the prior art.
Figure 3:
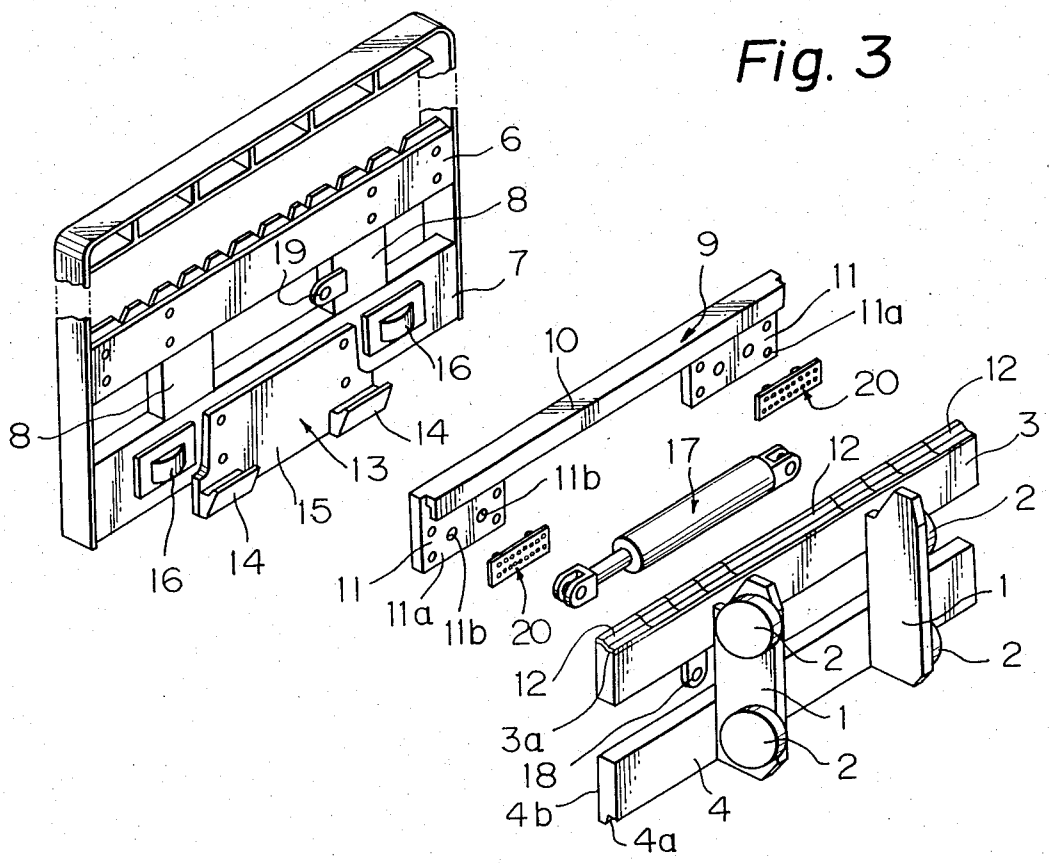
FIG. 3 is an exploded perspective view of a side shifting attachment from which fork tines are removed, according to an embodiment of the present invention.
Figure 5:
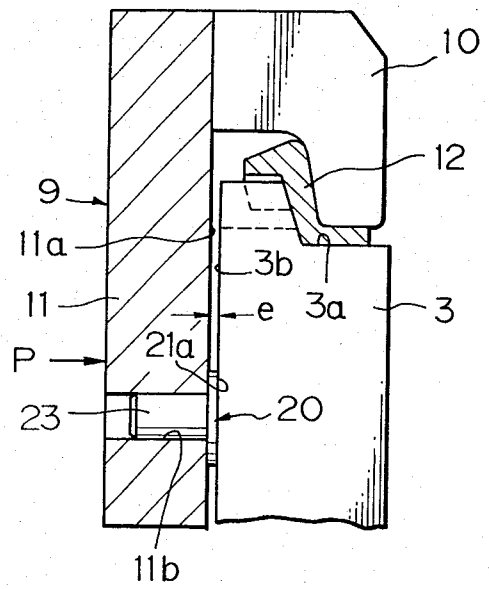
FIG. 5 is an enlarged view of the portion "A" of FIG. 4.
Figure 4:
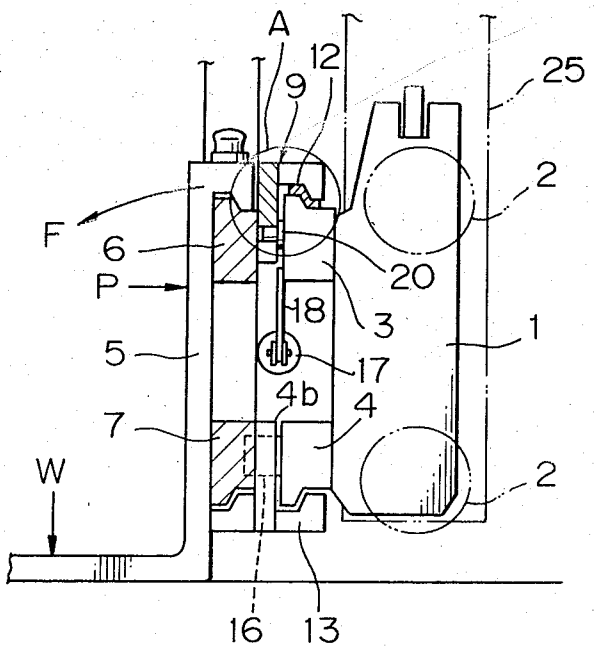
FIG. 4 is a partial cross-sectional view of the assembled side shifting attachment of FIG. 3 with fork tines.

The typical conventional side shift attachment shown in FIGS. 1 and 2 is attached to upper and lower finger bars 102 and 103 fixed to a lift bracket 101 movable up and down by means of rollers 99 on upright masts 100. The side shift attachment is provided with a lower fork bar 105 with which a lower part of the fork tines 104 is engaged and an upper fork bar 108 with which an upper part of the fork tines 104 is engaged. A lower shifter 106 in the form of a hook is fixed to the rear side of the lower fork bar 105 and is engaged with the lower finger bar 103. A roller or rollers 107 are arranged between the lower shifter 106 and the lower finger bar 103 for permitting the lower shifter 106 together with the lower fork bar 105 to slide along the lower finger bar 103.

In other conventional side shifting attachments the rollers 107 are replaced by a liner member. In this type of side shifting attachment, an upper shifter 109 in the form of a hook is fixed to the rear side of the upper fork bar 108 and is slidably engaged with the upper finger bar 102 via a liner 110 and shims 111. The liner 110 intervened between an inclined inner face **109*a* of the upper shifter 109 and an inclined outer face 102*a* of the upper finger bar 102, and the shims 111 arranged between the liner 110 and the inclined outer face 102, are provided for reducing a gap e left between confronting faces 102***b* and 109*b* of the upper finger bar 102 and the upper shifter 109. However, if the gap e between the two confronting faces 102*b* and 109*b* is too small, these two faces 102*b* and 109*b* will come into contact with one another when the upright masts 100 are tilted backward. As a result, if while the upright masts 100 are tilted backward, the upper shifter 109 is transversally shifted along the upper finger bar 102, abrasion will occur between the two confronting faces 102*b* and 109*b* which will lead to a deterioration in the physical condition of both the upper finger bar 102 and the upper shifter 109. Accordingly, a minimum gap width e must be set as shown in FIGS. 1 and 2. This gap e, however, permits the upper shifter 109 to be shifted backward toward the upper finger bar 102 when a backward pressure P is applied from a load to the fork tines 104 during a load handling operation of the fork lift truck, such as, for example, initial insertion of the fork tines 104 beneath the load, and to be pulled forward away from the upper finger bar 102 when the load gravity W acts on the fork tines 104. A momentum load F also occurs and acts on the fork tines 104 during hoisting of the load. The backward and forward movements of the upper shifter 109 are repeated during various load handling operations and cause the liner 110 to move, i.e., causes play, between the upper finger bar 102 and the upper shifter 109. This play causes the shims 111 to be moved out of position between the upper finger bar 102 and the liner 110.

The side shifting attachment according to the present invention will now be described with reference to the drawings.

In FIGS. 3 through 6 there is shown a pair of lift brackets 1 arranged to be moved up and down on respective upright masts 25 (FIG. 4) disposed on the foremost end of the body of a fork lift truck (not shown). Each lift bracket 1 is provided with two or more vertically spaced rollers 2 capable of a rolling movement along the corresponding upright mast 25. The two lift brackets 1 are mechanically connected together by upper and lower finger bars 3 and 4 attached to vertically spaced upper and lower positions of the two lift brackets 1. The upper and lower finger bars 3 and 4 are arranged so as to transversely extend on the fore end of the lift truck body. The upper finger bar 3 is formed with a stepped engagement portion 3*a* on the uppermost edge, and the lower finger bar 4 is formed with a stepped engagement portion 4*a* on the lowermost edge.

Figure 6:
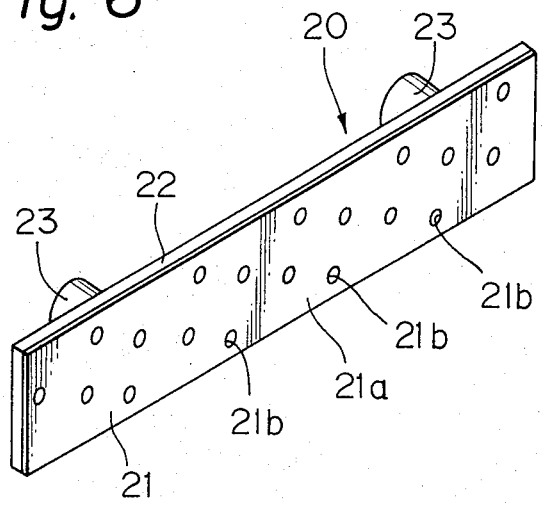
FIG. 6 is an enlarged perspective view of a slide pad means employed in the side shifting attachment of FIG. 3.

A side shifting attachment able to be attached to the upper and lower finger bars 3 and 4 has a pair of upper and lower fork bars 6 and 7 with which a fork 5 having fork tines is engaged. The upper and lower fork bars 6 and 7 are connected together by two transversely spaced connecting plates 8. The upper fork bar 6 has a transversely extending upper shift bar 9 fixedly attached to the rear face of the upper fork bar 6. The upper shift bar 9 consists of a hanger member 10 able to be slidably engaged with or hung on the engagement portion 3*a* of the upper finger bar 3, and two mounting brackets 11 transversely spaced from one another. A liner 12 is intervened between the hanger member 9 of the upper shift bar 9 and the engagement portion 3*a* of the upper finger bar 3 when the former is engaged with the latter. The lower fork bar 7 has a lower shift bar 13 fixedly and centrally attached to the rear face of the lower fork bar 7. The lower shift bar 13 consists of a mounting plate 15 and two hook members 14 transversely spaced apart from one another on the face of the mounting plate 15. The two hook members 14 are engageable with the stepped engagement portion 4*a* of the lower finger bar 4, and operate to prevent the lower fork bar 7 from being separated from the lower finger bar 4 when pulled forward. In this embodiment, the lower finger bar 7 also has a pair of slide guide members 16 in the form of a roller. The slide guide members 16 are arranged to be transversely spaced apart from one another and slidably engaged with a front face 4*b* of the lower finger bar 4, to permit smooth transverse movement of the lower fork bar 7. A side shift actuator 17 consisting of a known fluid-operated cylinder is arranged between the upper and lower finger bars 3 and 4 and on the rear side of the upper and lower fork bars 6 and 7. The side shift actuator 17 is provided for actuating the transverse shifting movement of the two fork bars 6 and 7. Therefore, one end of the transversely arranged side shift actuator 17 is fixed to a bracket 18 hanging from the upper finger bar 3 that is transversely stationary, and the other end of the side shift actuator 17 is fixed to a bracket 19 secured to one of the connecting plates 8. On rear faces 11*a* of the two mounting brackets 11*a* of the upper shift bar 9, there are mounted slide pads 20 which are disposed in a gap e defined between the rear faces 11*a* of the two mounting brackets 11 and a front face 3*b* of the upper finger bar 3. That is, each slide pad 20 has a predetermined thickness corresponding to the above-mentioned gap e, and is slidably engaged with the front face 3*b* of the upper finger bar 3. Each slide pad 20 is also removably mounted in mounting holes 11*b* bored in the corresponding mounting bracket 11. Therefore, the two slide pads 20 are able to constantly maintain the gap e between the upper shift bar 9 and the upper finger bar 3, thus preventing the upper shift bar 9 from being moved backward toward the finger bar 3. As illustrated in FIG. 6, each slide pad 20 has a base 22 made of soft iron material and a slide-bearing surface 21*a* made of bronze or gun metal and affixed to the base 22. The slide-bearing surface 21*a* has a plurality of recesses 21*b* formed thereon for retaining lubricant. The base 22 has pins 23 fixed thereto on the side opposite to the slide-bearing surface 21*a*, which can be loosely fitted in the mounting holes 11*b* of the corresponding mounting bracket 11.

In accordance with the above-mentioned construction and arrangement of the side shifting attachment of the present embodiment, a pressing load P applied to the side shifting attachment can be resisted by the slide pads 20 bearing against the front face 3*b* of the upper finger bar 3. That is, any backward movement of the upper shift bar 9 can be prevented when the pressing load P is applied from a load to the side shifting attachment via the fork 5. As a result, no direct contact of the upper shift bar 9 with the upper finger bar 3 occurs during various load handling operations of the fork lift truck. Accordingly, any wear of the upper shift bar 9 and the upper finger bar 3 due to abrasion can be avoided, thus prolonging the working life of the side shifting attachment.

On the other hand, when a gravity load W is applied from a load to the side shifting attachment, this gravity load "W" can be resisted by the liner 12 without affecting the slide pads 20. Accordingly, the upper shift bar 9 is maintained in a stationary position by the cooperation of the slide pads 20 and the liner 12. Consequently, any play of the liner, as encountered by the conventional side shifting attachment, can be prevented. Further, provision of the slide pads 20 positioned in the gap e enables the omission of the conventionally employed shims, eliminating the need for troublesome shim adjustments during the assembling process of the side shifting attachment, and resulting in a reduction of the manufacturing cost of the side shifting attachment.

Figure 7:
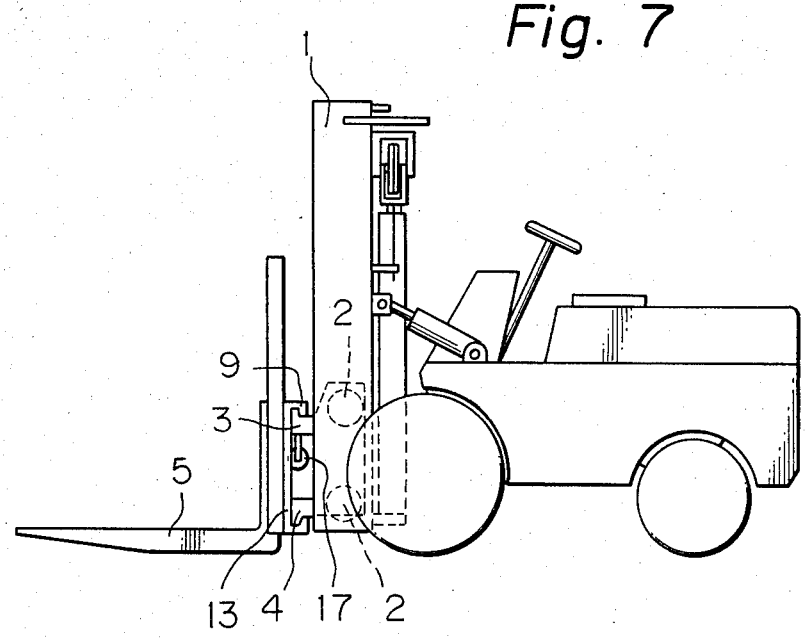
FIG. 7 is a general view of a fork lift truck equipped with the side shifting attachment according to an embodiment of the present invention.

FIG. 7 illustrates a general view of a fork lift truck equipped with the side shifting attachment according to the described embodiment of the present invention.

It should be understood that since the foregoing description is directed to a preferred embodiment of the present invention, modification or variation may occur without departing from the scope of the spirit of the present invention. For instance, the slide pads attached to the upper shift bar of the embodiment alternatively may be attached to the front face of the upper finger bar.

I claim:

1. In a fork lift truck having a lift bracket movable up and down on upright masts, and a pair of upper and lower finger bars extending transversely and attached to upper and lower spaced positions of the lift bracket, respectively, a side shifting attachment secured to the upper and lower finger bars for shiftably supporting thereon fork tines comprising: a transversely extending upper fork bar engageable with an upper end of said fork tines; a transversely extending lower fork bar vertically spaced from said upper fork bar and engageable with a lower end of said fork tines; upper shift bar means fixed to said upper fork bar and transversely slidably engaged with said upper finger bar via a transverse liner, said upper shift bar means including a plurality of mounting holes; a lower shift bar means fixed to said lower fork bar and transversely slidably engaged with said lower fork bar; a shift actuator arranged in front of said upper and lower finger bars for producing a transverse shift of said upper and lower fork bars along said upper and lower finger bars; slide guide means arranged between said lower fork bar and said lower finger bar for sliding said lower fork bar during the transverse shift of said upper and lower fork bars, and; slide pad means arranged between said upper fork bar and said upper finger bar for smoothly moving said upper fork bar during the transverse shift of said upper and lower fork bars, said slide pad means including a pair of transversely spaced slide plate members attached to said upper shift bar means and each having a plain face, respectively, in contact with a plain surface of said upper finger bar, and at least one mounting pin provided on a rear face of each slide plate member for removably securing said slide plate members in corresponding mounting holes of said upper shift bar means in a loose mounting arrangement.

2. A side shifting attachment as set forth in claim 1, wherein said upper and lower fork bars are connected together by vertical connecting bar means having a bracket to which one end of said shift actuator is fixed, and wherein one of said upper and lower finger bars has a bracket to which the other end of said shift actuator is fixed.

3. A side shifting attachment as set forth in claim 1, wherein said slide plate members of said slide pad means are provided, respectively, with a slide-bearing surface made of bronze material.

4. A side shifting attachment as set forth in claim 3, wherein said slide-bearing surface is formed with a plurality of recesses for retaining lubricant.

* * * * *